United States Patent [19]

Stewart et al.

[11] Patent Number: 5,005,259

[45] Date of Patent: Apr. 9, 1991

[54] OPENING ROLLER FOR OPEN END SPINNING MACHINES

[75] Inventors: William R. Stewart, Craigmount; David B. Stewart, Navay Park, both of Scotland

[73] Assignee: William R. Stewart & Sons Ltd., Scotland

[21] Appl. No.: 175,600

[22] Filed: Mar. 30, 1988

Related U.S. Application Data

[63] Continuation of Ser. No. 89,162, Aug. 25, 1987, abandoned, which is a continuation of Ser. No. 559,006, Dec. 8, 1983, abandoned, which is a continuation of Ser. No. 306,344, Sep. 29, 1981, abandoned.

[30] Foreign Application Priority Data

Sep. 26, 1980 [GB] United Kingdom ..... 803177

[51] Int. Cl.[5] ..... D01G 19/10

[52] U.S. Cl. ..... 19/97; 19/112

[58] Field of Search ..... 19/97, 94, 80 A, 54, 19/217, 112, 114; 57/404, 405, 408, 412, 417

[56] References Cited

U.S. PATENT DOCUMENTS

| | | | |
|---|---|---|---|
| 31,574 | 2/1861 | Greene | 19/97 |
| 188,164 | 3/1877 | Miles et al. | 19/112 |
| 761,170 | 5/1904 | Heim | 19/97 |
| 4,163,304 | 8/1979 | Laflaqueire et al. | 19/97 |
| 4,196,496 | 4/1980 | Stauffer et al. | 19/97 |
| 4,249,286 | 2/1981 | Stalder | 19/97 |

FOREIGN PATENT DOCUMENTS

| | | | |
|---|---|---|---|
| 267187 | 5/1912 | Fed. Rep. of Germany | 19/97 |
| 2544291 | 4/1977 | Fed. Rep. of Germany | 19/97 |

*Primary Examiner*—Steven N. Meyers

*Attorney, Agent, or Firm*—Cushman, Darby & Cushman

[57] ABSTRACT

A pinned opening roller for an open end spinning machine wherein the pinning pattern around the circumferential surface of the roller is provided by spaced pairs of rows of pins which may extend parallel to the rotational axis of the roller, the spacing between the pairs of rows being greater than the spacing between the rows in each pair and in any pair, the pins in one row being staggered relative to those in the other row.

Preferably, for a 7½" circumference roller approximately 1" wide the pins in each row are spaced 0.1" apart and the rows in a pair are 0.03" apart and there are 28 pairs of rows around the circumference.

Preferably, the pins in one row of a pair are each spaced equidistant from their adjacent pins in the other row and the pins in the first row of each pair are helically arranged and those in the second row of each pair also extend helically around the circumference of the roller.

6 Claims, 1 Drawing Sheet

OPENING ROLLER FOR OPEN END SPINNING MACHINES

This is a continuation of application Ser. No. 089,162, filed Aug. 25, 1987, which was abandoned upon the filing hereof, which is a continuation of Ser. No. 559,006 filed Dec. 8, 1983, now abandoned, which is a continuation of Ser. No. 306,344 filed Sep. 29, 1981, now abandoned.

BACKGROUND OF THE INVENTION

This invention relates to pinned opening rollers or beaters for open end spinning machines wherein a sliver or untwisted rope of fibres is separated by the opening or combing roller or beater into individual fibres, which are assembled into a yarn. Such an opening roller carries an array of sharp projections which may either be in the form of saw-toothed wire wound helically onto the circumferential surface of the roller or of individual pins projecting from the said surface of the roller.

Conventionally two types of pin pattern have been used for the pinned type of roller with the basic difference that in one type the distance from pin to pin within a row is approximately equal to the distance between the rows (equal relationship) while in the other pattern (unequal relationship) a similar number of pins are disposed in each roller, but there are fewer rows with more pins in each row, than is the case with the equal relationship.

Both these alternative type of roller can be used, one type being more suited to some designs of open end spinning machines and the other for other designs of machine.

In order to provide a sufficiently intensive opening action on the fibres, the distance from pin to pin in each row in the case of the opening roller with unequal relationship has to be relatively close. This in turn limits the diameter of the pin which can be utilised as sufficient roller material has to be left for the matrix holding the pins not to be unduly weakened. Furthermore, the reduced diameter of the pins means they are weaker and also wear more quickly.

SUMMARY OF THE INVENTION

From another point of view, as the sliver being combed is firmly held between the feed roller and the feed shoe in the spinning unit of the machine, adequate drafting space or free space between the pins must be allowed as otherwise the opening roller will tend to clog or lap-up. This requirement also limits the distance between the centre lines of adjacent pins in each row.

Drafting space is thus a compromise between the number of pin points required within a row, and the pin diameter.

In one example of a known pinning pattern of equal relationship, pins of 19's gauge (0.042") are set in rows with approximately 0.100" between rows and 0.100" between pins within the rows.

A known example of an unequal relationship uses pins of 24's gauge (0.0245") set in rows 0.200" apart with a 0.050" between pins within the row.

Another factor to be considered in designing opening rollers is the pin shape. Practical experience has shown that a pin whose point encloses a relatively large cone angle is preferably to one which is needlepointed. Thus for a given pin projection a relatively large diameter pin has textile technological advantages in open end spinning.

The 0.042" pin in the first example above with a taper length of 0.125" has a point cone angle of 19° while the 0.0245" from the second example with a similar taper length has a point cone angle of 11°.

Ideally, therefore, one requires high pin tip density in the rows, with pins whose diameter is sufficient to give long life, and yet the density of the pins in each row at their base where they are secured in the roller matrix must be as low as possible, so as not to weaken the matrix.

The present invention has been designed to meet these conflicting requirements of pin point density and pin diameter with its consequent effects on pin point cone angle and pin strength and wearing properties.

According to the present invention, we provide an opening roller for use in open end spinning machines wherein the opening action is provided by an array of pins secured in and projecting by a uniform amount from the circumferential surface of the roller, wherein the pins are arranged in spaced pairs of rows which may be parallel to the rotational axis of the roller, the spacing between the pairs being greater than the spacing between the rows in any pair of rows, and in any pair, the pins in one row being staggered relative to those in the other row.

Each such double row or pair of rows of pins permits an adequate number of pins in each axial group of pins, i.e. each pair of rows, while allowing the pin diameter to be sufficiently large to permit a suitable pin cone angle.

Preferably, in any pair of rows the pins in one row are located mid-way between the pins in the other row. Thus, the pair of rows of pins gives a pin density which is twice that of a single row.

If desired, the pins can be arranged around the circumference of the roller in a plurality of helices, the pin pattern around the circumference being repeated four times.

In a preferred arrangement, the roller has twenty eight pairs of rows of pins located around the circumference of the roller, which measures about 7½", and 8 or 9 pins are provided in each row, spaced approximately 0.1" apart. In this arrangement, the rows of each pair are set about 0.03" apart.

Preferably, the pins are of 19's gauge.

One embodiment of opening roller in accordance with the invention is now described by way of example with reference to the accompanying partly schematic drawing which shows a development of the circumferential plane of a pinned roller.

The overall construction of the pinned opening roller is known and basically the roller comprises a central hub having a central axial aperture therein about the central axis of which the roller rotates at high speed, the hub projecting from a central portion of one side wall of the roller. This side wall is connected to the opposite side wall by a cylindrical pinned portion of the roller, the other side wall being open and defined merely by an annular portion connected to the cylindrical pinned portion and an end face of the central hub. The rear ends of the pins project from the rear face of the cylindrical pinned portion towards the hub and the space between the cylindrical portion and the cylindrical surface of the hub may be filled with a plastics material totally encompassing the rear ends of the pins. The outer surface of the cylindrical pinned portion is recessed relative to the periphery of the side walls and the pin heads are located in this recessed portion. The present invention is concerned with the pinning pattern of the cylindrical portion.

Figure 1:
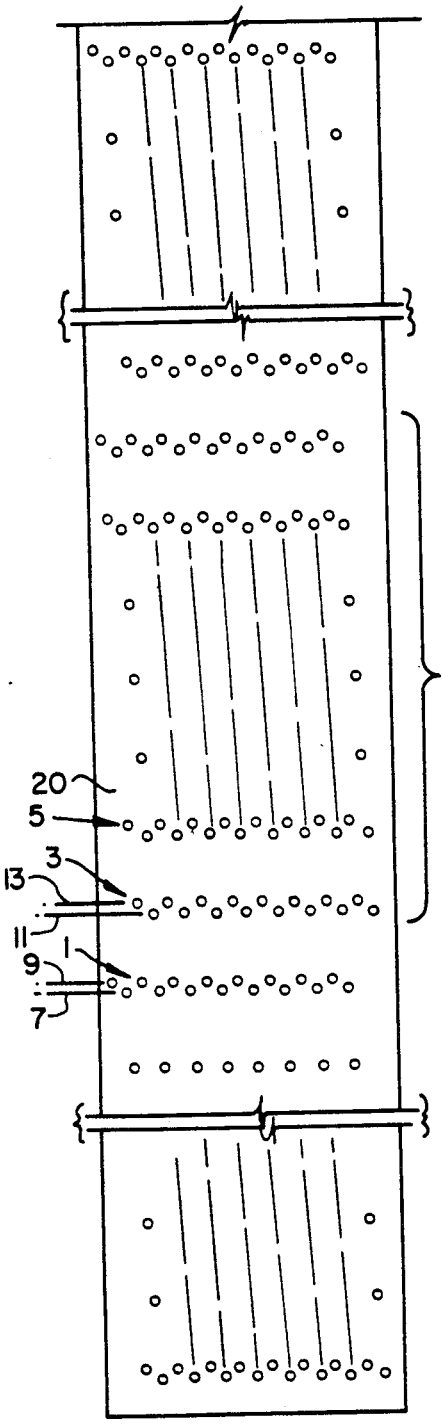
FIG. 1 is a systematic development of the external circumferential plane of the cylindrical portion of an opening or combing roller provided in accordance with an embodiment of the invention.

Referring to the FIG. 1, the pins are arranged in the cylindrical portion 20 in pairs of rows 1, 3, 5, etc. The two rows in the pair 1 are indicated at 7 and 9 whereas the two rows in the pair 3 are indicated at 11 and 13. In each row 7–13 etc. which rows extend parallel to the rotational axis of the roller, the pins are equally spaced from each other and in any pair of rows 1, 3, 5, etc. the pins in one row are staggered relative to the pins in the other row. The spacing between the pairs of rows is greater than the spacing between the rows in any pair of rows.

Figure 2:
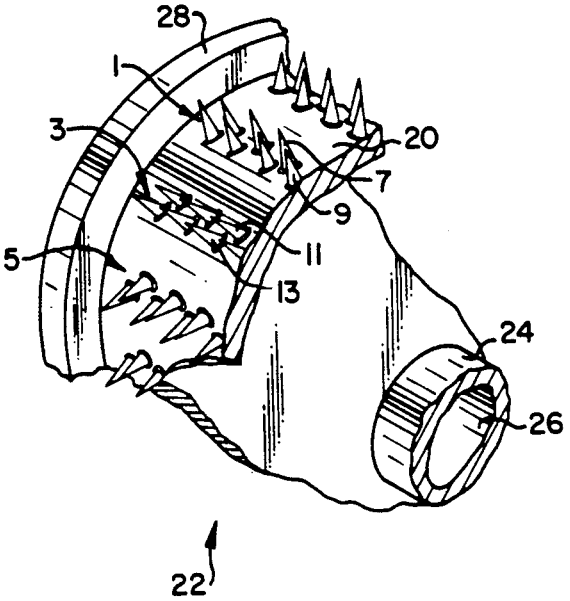
FIG. 2 is a schematic perspective view partially in sections and partially broken away for clarity showing the pins of the invention on the cylindrical portion of an opening or combing roller.

FIG. 2. systematically illustrates the pinning pattern provided in accordance with the present invention defined on the cylindrical portion 20 of an opening roller 22. The opening roller 22 includes a central hub 24 having a central axial aperture 26 therein. First and second side walls 28 are provided (only one of which is shown for clarity in FIG. 2), the side walls being connected to one another by the cylindrical portion 20 of the roller 22. As also noted above, the structure of the opening roller itself is known and it is the pinning pattern provided on the cylindrical portion of the roller which is the subject of the present invention.

In a preferred arrangement the pins in the rows 9 and 13 are located mid-way between the pins in the rows 7 and 11 respectively. In an alternative construction, the first row of pins in each pair is located on a helix and likewise, the second row of pins in each pair is located on a further helix.

In a preferred arrangement, for a roller having a circumference of about 7½" and being about 1" wide, the pins in each row are preferably spaced apart by 0.1" thus meaning that 8 or 9 pins can be provided in each row and the circumferential spacing between the two rows in any pair of rows is about 0.03", that is, for example, the distance between the rows 7 and 9. This means that the approximate spacing between each pair of rows, e.g. the distance between the centre line of the row 9 and the centre line of row 11 is about 0.238". Furthermore, the pins are arranged in a helical pattern around the circumference of the roller. In a preferred arrangement there are 28 pairs of rows of pins which means that the pin pattern around the circumference of the roller can be repeated four times, there being 7 pairs of rows of pins in each repeating pattern and each repeating pattern has 8 or 9 helical rows of pins in the circumferential direction defined by the pins in one axial row between which are 8 or 9 further helical rows of pins defined by the pins in the other axial rows of each pair.

By arranging the pinning pattern in this way, 19's gauge pins (0.042" diameter) can be used rather than the smaller 24's gauge pins which would otherwise be necessary if the quantity of pins in a pair of rows was used in a single row. In this way the matrix material forming the cylindrical pinned surface is not weakened when drilled to receive the pins (which are of course located in position in known manner). By being able to use the larger diameter pins, pins with large cone angles at the point can of course be used which has considerable technological advantages in open end spinning.

It will of course be appreciated that many other different pinning arrangements in accordance with the present invention are possible provided that the pins are set in pairs of rows wherein the rows in a pair are closer together than are adjacent pairs of rows.

It is not essential for the pins to be helically orientated around the circumference of the roller and other known arrangements can be used.

What is claimed is:

1. An opening roller for use in open end spinning machines, and for separating fibers from a sliver prior to the fibres being spun into a yarn, comprising a cylindrical member having spaced first and second side walls and a central hub, said first side wall extending radially outwards from said hub, and at or adjacent a peripheral edge of said first side wall, a continuous cylindrical wall extending across the width of the roller to said second side wall of the roller and defining the width of said roller, there being a plurality of spaced pairs of rows of pins projecting from said continuous cylindrical wall, wherein the spacing between adjacent pairs of rows of pins is greater than the spacing between the rows in any pair of rows, and wherein the area of said roller between each of said pairs of rows is smooth and arcuate, and forms part of said cylindrical surface, and wherein, in any pair of rows, the pins of one row are staggered relative to the pins of the other row.

2. An opening roller according to claim 1 wherein the pins are arranged around the circumference of the roller in a plurality of helices.

3. An opening roller according to claim 1 wherein 28 pairs of rows of pins are located around the circumference of the roller which measures about 7½".

4. An opening roller according to claim 3 wherein 8 or 9 pins are provided in each row spaced approximately 0.1" apart.

5. An opening roller according to claim 3 wherein the rows of each pair of rows are set about 0.03" apart.

6. An opening roller according to claim 3 wherein the pins are of 19's gauge.

* * * * *